US006419248B1

(12) United States Patent
Kay

(10) Patent No.: US 6,419,248 B1
(45) Date of Patent: Jul. 16, 2002

(54) WHEELED VEHICLE WITH CONTROL SYSTEM

(76) Inventor: Albert R. Kay, P.O. Box 362, Burney, CA (US) 96013

( * ) Notice: Subject to any disclaimer, the term of this patent is extended or adjusted under 35 U.S.C. 154(b) by 0 days.

(21) Appl. No.: 09/712,070

(22) Filed: Nov. 13, 2000

Related U.S. Application Data

(63) Continuation-in-part of application No. 09/150,633, filed on Sep. 9, 1998, now Pat. No. 6,158,752.

(51) Int. Cl.[7] ..... A63C 17/02
(52) U.S. Cl. ..... 280/87.042; 280/87.01
(58) Field of Search ..... 280/87.042, 87.043, 280/87.01, 11.19, 11.28, 11.27

(56) References Cited

U.S. PATENT DOCUMENTS 1,622,198 A * 3/1927 Keeler ..... 280/222
3,152,812 A * 10/1964 Cummings ..... 280/11.19
4,120,510 A * 10/1978 Hillard ..... 280/11.28
5,372,384 A * 12/1994 Smith ..... 280/11.28
5,458,351 A * 10/1995 Yu ..... 280/11.28
5,551,717 A * 9/1996 De Courcey Milne . 280/87.042
5,947,495 A * 9/1999 Null et al. ..... 280/87.01
6,193,249 B1 * 2/2001 Buscaglia ..... 16/35 D
6,227,555 B1 * 5/2001 Wang et al. ..... 280/87.042
6,270,096 B1 * 8/2001 Cook ..... 280/11.221

FOREIGN PATENT DOCUMENTS

JP 10-314366 A * 12/1998

* cited by examiner

*Primary Examiner*—Lanna Mai
*Assistant Examiner*—Ruth Ilan
(74) *Attorney, Agent, or Firm*—Theodore J. Bielen, Jr.

(57) ABSTRACT

A vehicle movable on at least first and second wheels utilizing a first platform having wheels attached to the same. A second platform is rotatably attached to the first platform and spaced outwardly from the first and second wheels attached to the first platform. Bosses, fixed to the second platform, extend to the vicinity of the first platform wheels. Linkages, such as rods, are rotatably attached to the bosses and to the wheels for provision of steering and braking controls. In certain embodiments, a third platform is employed to activate a braking wheel.

8 Claims, 8 Drawing Sheets

WHEELED VEHICLE WITH CONTROL SYSTEM

CROSS-REFERENCE TO RELATED APPLICATIONS

The present application is a Continuation-in-Part of U.S. patent application Ser. No. 09/150,633, filed Sep. 9, 1998, now U.S. Pat. No. 6,158,752.

BACKGROUND OF THE INVENTION

The present invention relates to a novel and useful wheeled vehicle having a control system.

Vehicles such as skateboards, scooters, and the like have found great popularity over the years with persons possessing a degree of athleticism. For example, youngsters have popularized such types of vehicle to the extent that competitive events exist to measure operational skills.

Unfortunately vehicles, such as skateboards and scooters, often lack adequate steering and braking controls. This deficiency has resulted in numerous injuries to persons using the same.

A wheeled vehicle having a novel control mechanism for steering and braking would be a notable advance in the recreational field.

BRIEF SUMMARY OF THE INVENTION

In accordance with the present invention a novel and useful wheeled vehicle having a braking and steering control system is herein provided.

The vehicle of the present invention utilizes a first platform, the undersurface of which is connected to first and second wheels in a swiveling manner. A second platform is rotatably attached to and spaced from the first platform. The second platform includes an upper surface for contact by the user of the vehicle.

Steering system of the present invention is further provided with a boss which is fixed to the second platform and extends to the vicinity of the first and second swiveling wheels connected to the first platform undersurface. The boss may extend through a slot. A first link is rotatably attached to the boss and rotatably attached to the first swiveling wheel. Likewise, a second link is rotatably attached to the second boss and rotatably attached to the second swiveling wheel.

In addition, third and fourth swiveling wheels are connected to the undersurface of the first platform. Another boss is fixed to the second platform and extends to the vicinity of the third and fourth wheels through a slot in the first platform. A third link rotatably attaches to the second boss and to the third swiveling wheel, while a fourth link rotatably attaches to the second boss and to the fourth swiveling wheel.

Each of the wheels may include a tab having a pair of sites for connecting the particular link extending from either the first or second bosses through the first platform.

In one embodiment of the invention, the second platform may be split into two independently rotatable portions relative to the first platform. With respect to such a case, either of the portions of the second platform may be tilted independently of one another. Moreover, any of the first, second, third, or fourth links connected to either of the bosses may be fastened to any one of the fastening sites of the wheel associated tabs. Thus, the forward portion of the board may be used to steer the vehicle while the rear portion may either be used to steer or to brake the vehicle. In this instance, either one or two persons may operate the vehicle.

Another embodiment of the present invention provides for three independent platforms, front, middle, and rear, each independently rotatable relative to the first platform. A single boss extends from the particular rotatable platform to the first platform. Also, each boss is linked to only one of the wheels. The rotating front platform steering wheel, thus, includes an active turning wheel and a following wheel. The rotating middle platform operated wheel which turns to aid in the steering of the vehicle. Lastly, the rotating rear platform turns a wheel adjacent the rotating middle platform wheel to effect a brake. This occurs by the user pressing the rear platform, and turning the wheel associated with the rear platform in a direction opposite to the wheel associated with the rotating middle platform.

A further embodiment of the present invention provides for a novel steering system for a vehicle. The steering system utilizes a slotted boss that extends from a first platform, through a second platform to a wheel attached to the first platform. A link is rotatably attached to the boss and the wheel, and is movable along the slotted boss to provide an adjustable steering control.

A braking system is also included in the present invention where a first platform us connected to first and second swiveling wheels. A second platform rotates toward the first platform. A rod connected to the second platform turns a shaft journalized at the first platform. A pair of tongues extending from the journalized shaft press against the first and second wheels to impede rotation of the wheels and to brake the vehicle.

It may be apparent that a novel and useful vehicle and steering system for the same has been described.

It is therefore an object of the present invention to provide a vehicle in which a steering mechanism may be employed by simply tilting one of a pair of spaced platforms in a particular direction.

Another object of the present invention is to provide a platform type vehicle which includes a braking system that is operable independently of the steering system of the platform vehicle.

A further object of the present invention is to provide a platform type vehicle which may be usable by one or two persons, each of which is capable of steering or braking the vehicle.

Yet another object of the present invention is to provide a platform-type vehicle which possesses versatility in that such vehicle is capable of moving in either of opposite directions, and a steering mechanism which is easily converted into a braking mechanism.

A further object of the present invention is to provide a platform-type vehicle which is relatively simple to manufacture and to maintain.

A further object of the invention is to provide a platform type vehicle which is rugged enough to be used on uneven surfaces.

The invention possesses other objects and advantages especially as concerns particular characteristics and features thereof which will become apparent as the specification continues.

For a better understanding of the invention reference is made to the following detailed description of the preferred embodiments thereof which should be taken with the prior described drawings.

DETAILED DESCRIPTION OF THE PREFERRED EMBODIMENTS OF THE INVENTION

Various aspects of the present invention will evolve from the following preferred embodiments of the invention which should be viewed with the prior delineated drawings.

Figure 1:
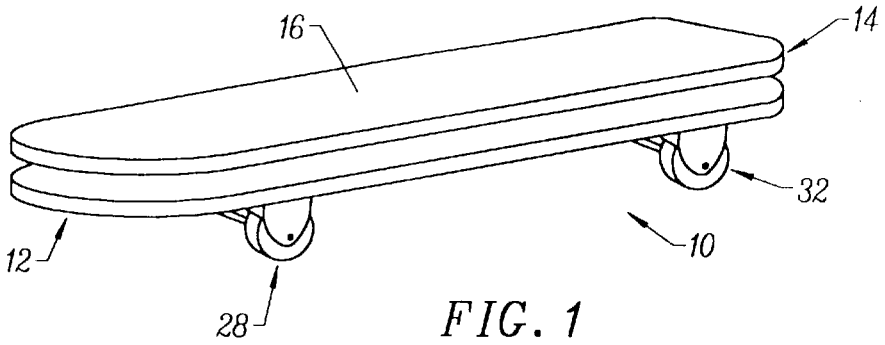
FIG. 1 is a top left perspective view of the vehicle of the present invention.
Figure 2:
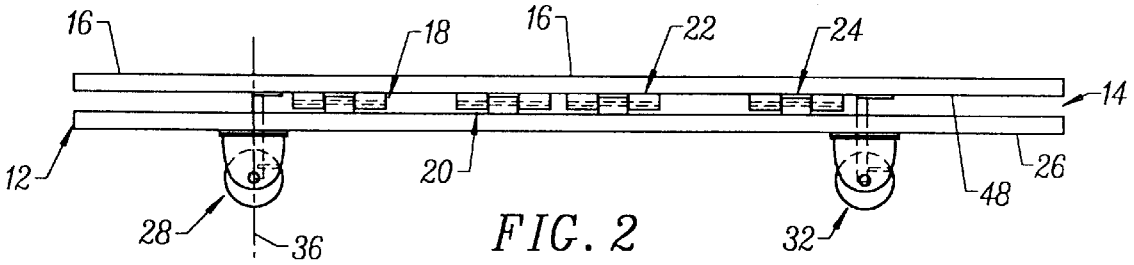
FIG. 2 is a side elevational view of the vehicle of the present invention.

The invention is shown in the drawings by reference character 10. The vehicle 10 includes a first platform 12 and a second platform 14 which are spaced from one another, FIG. 1. Second platform 14 includes an upper surface 16 which is intended to support the user or users of vehicle 10. It should be noted that vehicle 10 may move left-to-right or right-to-left as depicted in FIGS. 1 and 2. Turning to FIG. 2, it may be observed that first platform 12 is rotatably attached to second platform 14 through a plurality of pivoting or journaled bearings 18, 20, 22, and 24. Thus, a second platform 14 is capable of tilting or listing relative to first platform 12, which will be detailed hereinafter. A damping mechanism may be placed between platforms 12 and 14 (not shown).

Figure 3:
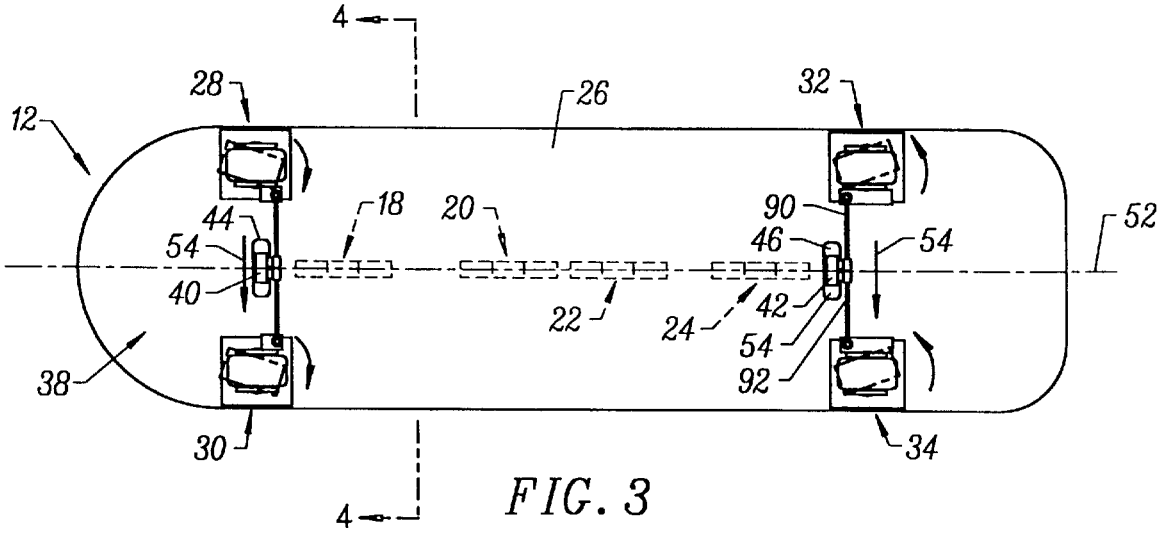
FIG. 3 is a bottom plan view of the vehicle of the present invention.

Turning to FIG. 3, it may be seen that a quartet of wheels are attached to lower surface 26 of first platform 12. First and second wheels 28 and 30 are paired to operate together. Likewise, third and fourth wheels, 32 and 34 are intended to operate in conjunction with one another. Wheels 28, 30, 32, and 34 swivel relative to first platform 12. The axes of such swiveling is generally perpendicular to lower surface 26 of first platform 12. Axis 36 of first wheel 28, FIG. 2, illustrates this relationship.

Figure 4:
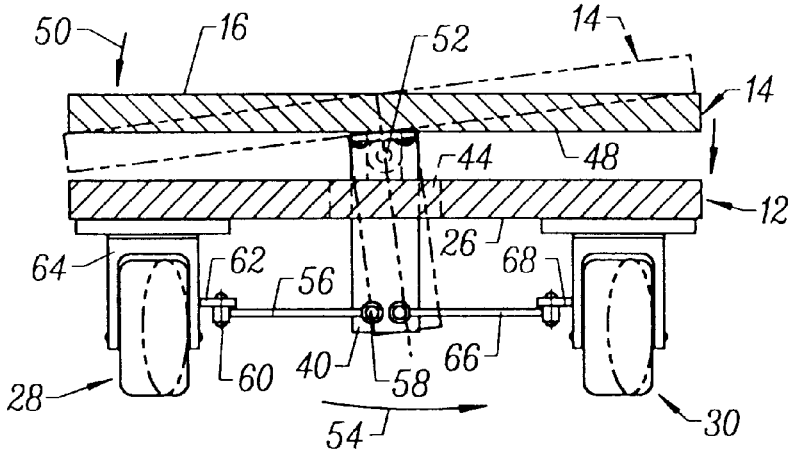
FIG. 4 is a sectional view taken along line 4—4 of FIG. 3.
Figure 5:
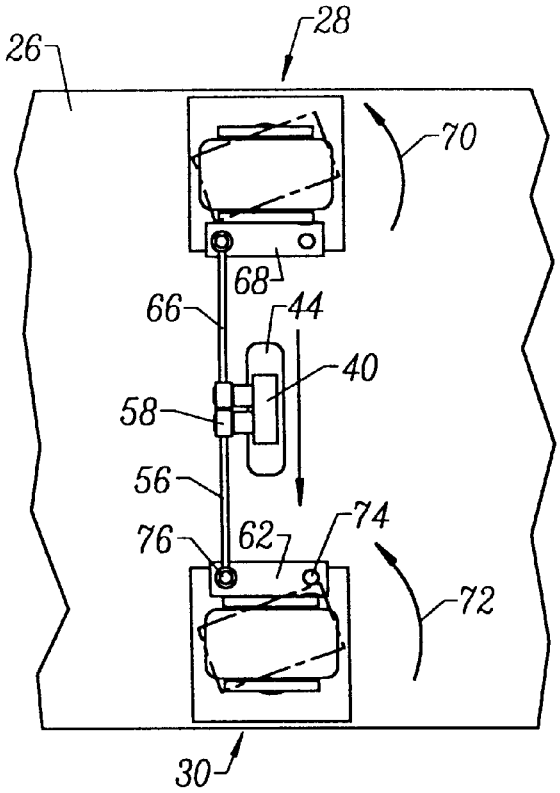
FIG. 5 is a bottom plan view of the first and second wheels depicted in FIG. 5, with linkages reversed.

Vehicle 10 also possesses a novel steering mechanism 38 best shown in FIGS. 3, 4, and 5. Steering mechanism 38 includes the provision of a pair of bosses or tongues 40 and 42 which are rigidly fixed to second platform 14 at undersurface 44 thereof by any suitable fastening means, such as screws, nails, bolts, adhesives, welds, and the like. Tongues 40 and 42 extend through slots 44 and 46 through first platform 12, respectively. As depicted on FIG. 4, tongue or boss 40, depending from undersurface 48 of second platform 14, is extending through slot 44 to the vicinity of wheels 28 and 30. In the embodiments depicted in FIGS. 1–5, boss 42 also extends through slot 46 in the same manner. FIG. 4 illustrates a tilting force placed on the edge of upper surface 16 of second platform 14, directional arrow 50, which causes second platform 14 to rotate about axis 52, causing tongue 40 to move toward wheel 30, directional arrow 54 of FIG. 4.

With further reference to FIG. 4, link 56 rotatably attaches to boss 40 at pivot 58. Link 56 also rotatably attaches to wheel 28 at pivot 60. Tab 62 on wheel skirt 64 of first wheel 28 provides the necessary place for pivot 60. Likewise, link 66 is similarly and rotatably fixed to tongue 40 and tab 68 of wheel 30. Looking at FIG. 5, it may be apparent that links 56 and 66 have been reversed to the opposite side of tongue 40 causing wheels 28 and 30 to move according to directional arrows 70 and 72, opposite to the direction depicted in FIG. 3. With respect to wheel 28 such reversal is achieved by moving link 56 from placement site or opening 74 of tab 62 to opening 76 of tab 62, as well as reversing pivot 58 from one side of boss 40 to the other. The same reversal has taken place with respect to link 66 associated with wheel 30. Turning to FIG. 3, it may be further apparent that wheels 32 and 34 turn oppositely to wheels 28 and 30 when the tilt, shown in FIG. 4, is achieved. Thus, a smooth turn of vehicle takes place.

Figure 6:
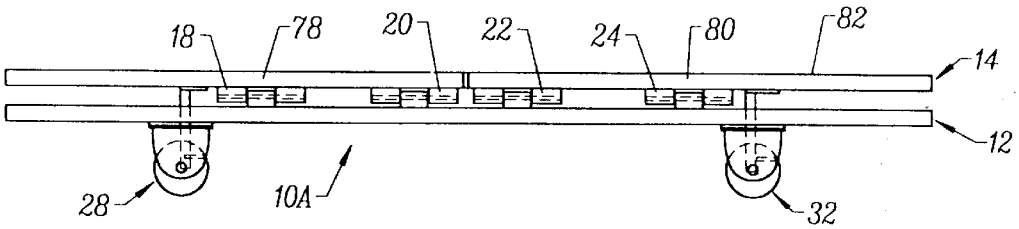
FIG. 6 is a side elevational view of a second embodiment of the present invention.
Figure 7:
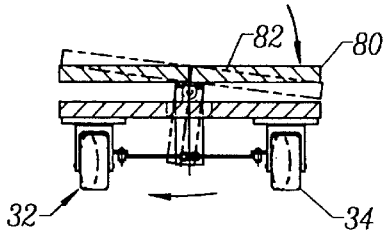
FIG. 7 is an end elevational view of the second embodiment of the present invention.
Figure 8:
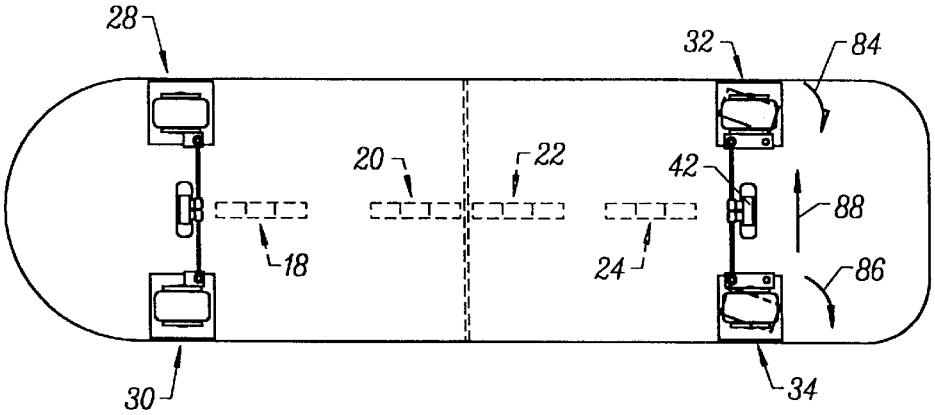
FIG. 8 is a bottom plan view of the second embodiment of the present invention.

Viewing now FIG. 6, another embodiment 10A of the vehicle of the present invention as depicted. In the embodiment shown in FIG. 6, second platform 14 has been split into a first portion 78 and a second portion 80. Thus, journal bearings 18 and 20 serve to connected first portion 78 to first platform 12 in an independently rotatable manner relative to second portion 80 of platform 14. FIGS. 7 and 8 illustrate such movement in which a tilting force has been applied to upper surface 82 of second portion 80 causing wheels 32 and 34 to rotate as shown in FIG. 8 through the movement of boss 42, directional arrows 84, 86, and 88. Wheels 28 and 30 have not been turned by such maneuver.

Figure 9:
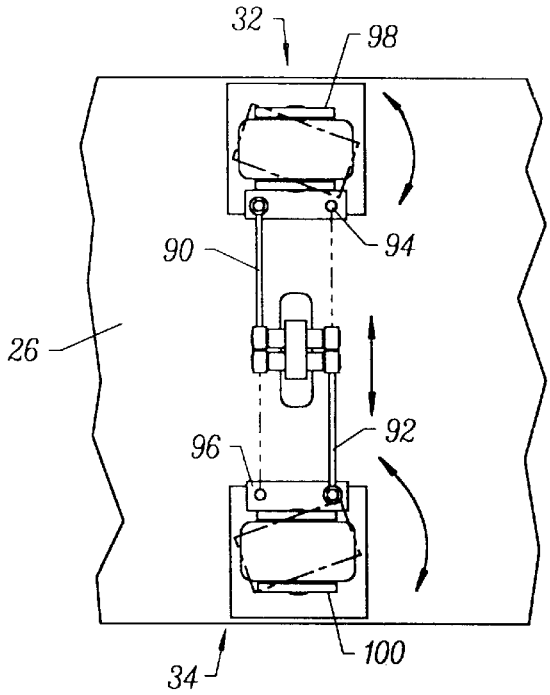
FIG. 9 is a bottom plan view of the third and fourth wheels of a portion of FIG. 8 in which wheels are configured for braking.

Turning to FIG. 9, links 90 and 92 associated with wheels 32 and 34, respectively, have been connected to tabs 94 and 96 on the skirts 98 and 100 of wheels 32 and 34. Any tilt of portion 80 of upper platform 14 will cause vehicle 10A to brake.

Figure 10:
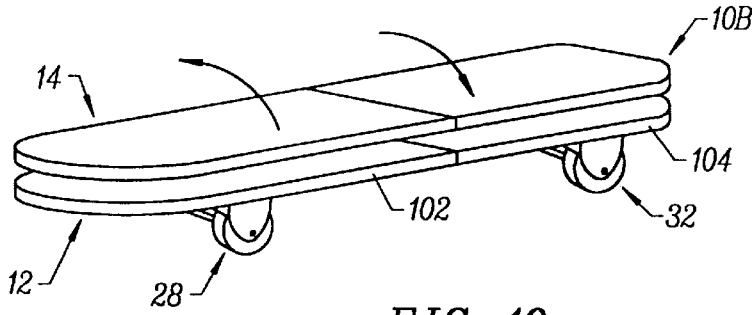
FIG. 10 is a top, left, front perspective view of a third embodiment of the present invention.
Figure 11:
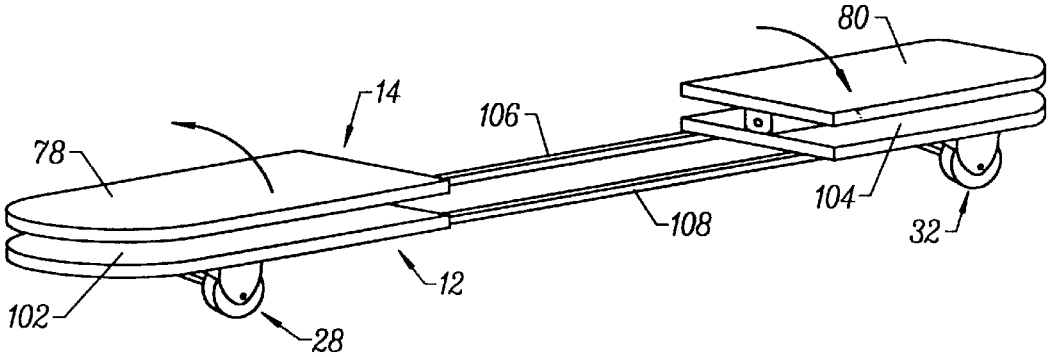
FIG. 11 is a top, left, front perspective view of the third embodiment of the present invention in which the first and second platforms have been separated.

Referring now to FIGS. 10 and 11, a further embodiment 10B of the invention is shown in which first platform 12 is also split into first portion 102 and second portion 104, in the embodiment 10B depicted therewithin. Rails 106 and 108 maintain the rigidity between portions 102 and 104, yet permit the independent rotation of portions 78 and 80 of second platform 14. Thus, if more than one person is using vehicle 10B, each person may be spaced from one another as desired. Leaves or spacers may be placed upon rails 106 and 108, in this regard.

With reference to FIGS. 12–16, another embodiment of the present invention, 10*c,* is shown. With respect to FIG. 12, a first platform 112 is shown. Swiveling wheels 114, 116, 118, and 120, are attached to the undersurface 122 of first platform 112 to allow rotation of the same relative to an axis normal to first platform 112, best shown in FIG. 14. Embodiment 10C provides for three platforms, 124, 126, and 128, each being rotatably connected to the upper surface 130 of first platform 112 via plurality of hinges or bearings 132, in a matter similar with respect to the embodiment 10A depicted in FIGS. 1–3. Again, multiplicity of springs 134 may or may not be employed between platform 112 and platforms 124, 126, and 128 (front, middle, and rear). Thus, platforms 124, 126, and 128 are capable of independently listing or tilting relative to first platform 112.

Figure 15:
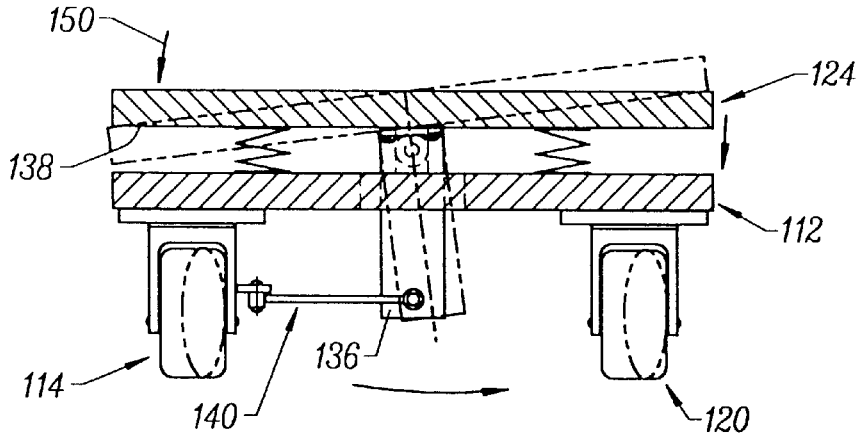
FIG. 15 is an embodiment taken along line 15—15 of FIG. 14.
Figure 16:
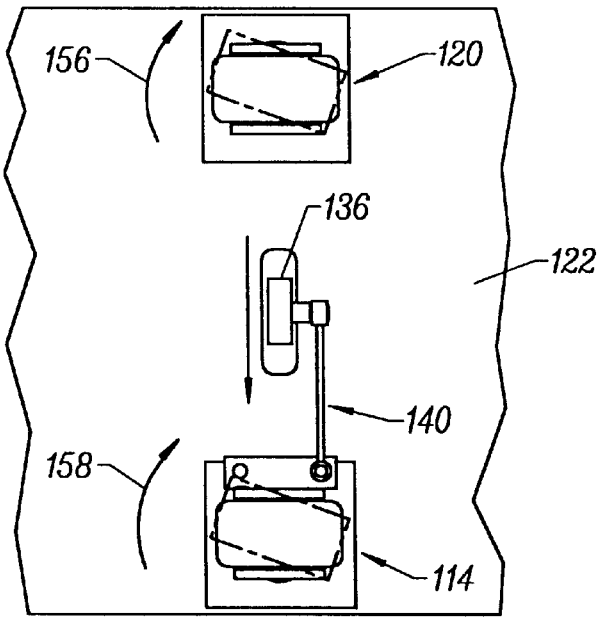
FIG. 16 is an enlarged bottom plan view of the front steering portion of the embodiment shown in FIG. 14.

With particular reference to FIGS. 15 and 16, tongue or boss 136 is fixed to undersurface 138 of platform 124 and extends downwardly through platform 112. Linkage 140 rotatably attaches boss 136 to wheel 114. Wheel 120 is a following wheel which turns according to the direction of turning of wheel 114, and is found on the vehicle 10C for the purpose of stability.

Platform 126 may be independently contacted or pressed to turn wheel 116. A boss 142 and linkage 144 permits the turning of wheel 116, as shown in FIG. 14, to turn vehicle 10C more sharply in the direction initiated by the turning of wheel 114.

Finally, platform 112 also includes a connected tongue or boss 146 and a linkage 148 which turns wheel 118. Wheel 118 is, thus, actuated by the pressing of platform 128 and serves as a brake when platform 128 is pressed on the same side as platform 126.

Figure 12:
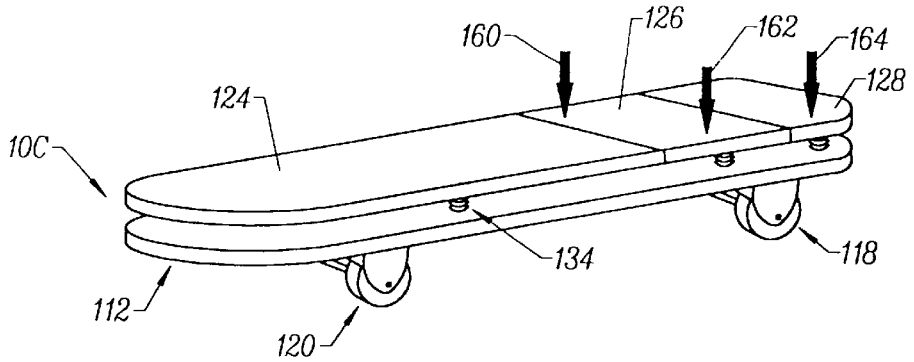
FIG. 12 is a top, left, perspective view depicting another embodiment of the present invention.
Figure 13:
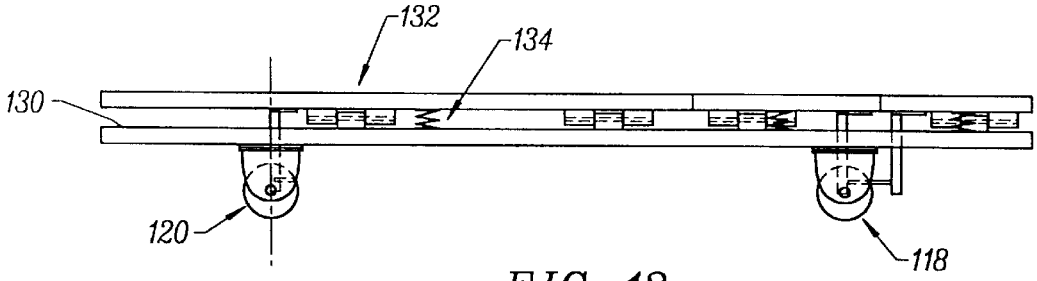
FIG. 13 is a side elevational view of the embodiment of FIG. 12.
Figure 14:
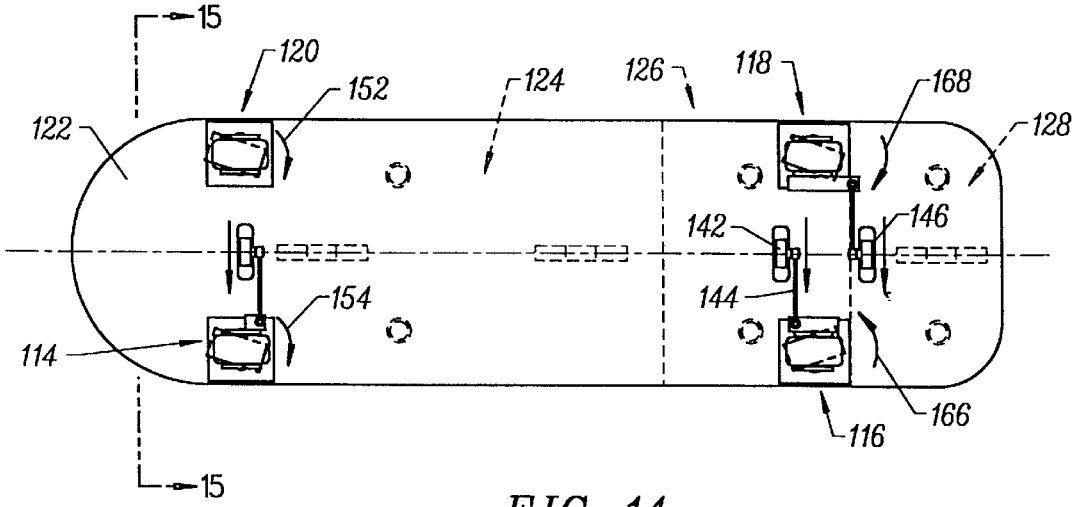
FIG. 14 is a bottom plan view of the embodiment of FIG. 12, showing the braking mode.

With reference to FIGS. 12–16 it may be seen that another embodiment 10C operates by the user steering vehicle 10C by pressing either edge of platform 124. FIG. 15 shows a force arrow 150 which tilts platform 124 to turn vehicle to the right, as viewed in FIG. 14, such that wheels 114 and 120 turn according to directional arrows 152 and 154, FIG. 14 and directional arrows 156 and 158 of FIG. 16. Pressing of platform 126 will aid in the turning of vehicle 10C when force is applied to directional arrow 160, FIG. 12. Braking is illustrated in FIGS. 12 and 14 by directional arrows 162 on platform 126 and directional arrow 164 in platform 128. In this manner, wheels 116 and 118 are turned oppositely to one another, directional arrows 166 and 168, to effect such braking. In general, platform 124 is employed to steer front wheels 114 and 120, middle platform 126 is employed to steer the rear wheel 116, and platform 128 is employed to actuate braking wheel 118, as shown.

Figure 17:
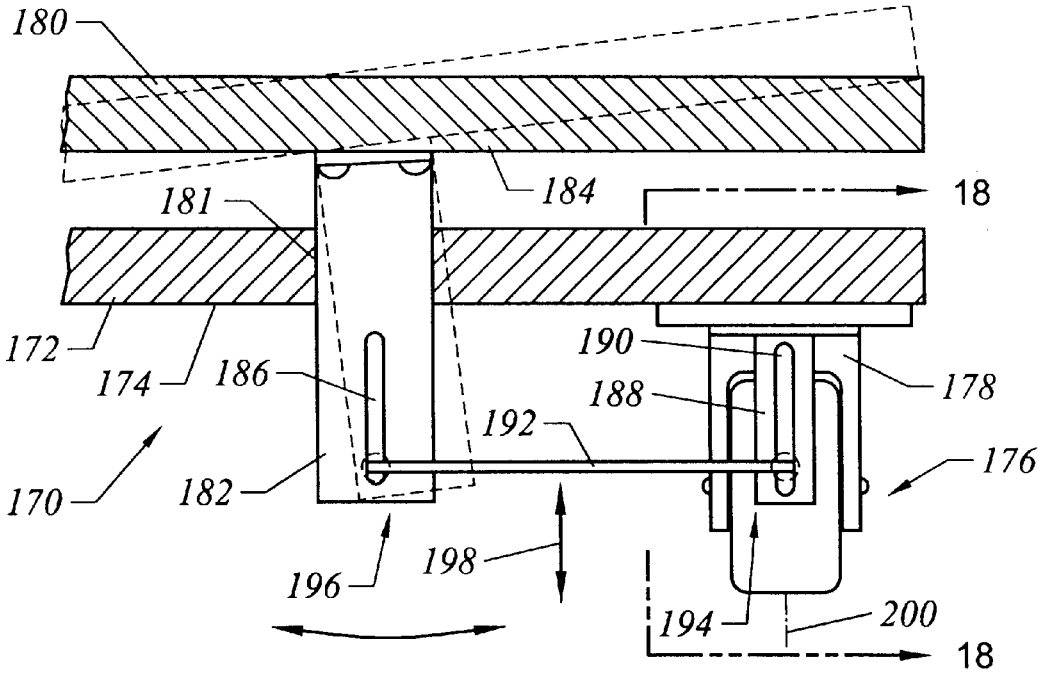
FIG. 17 is a broken front sectional view of an adjustable steering system of the present invention.
Figure 18:
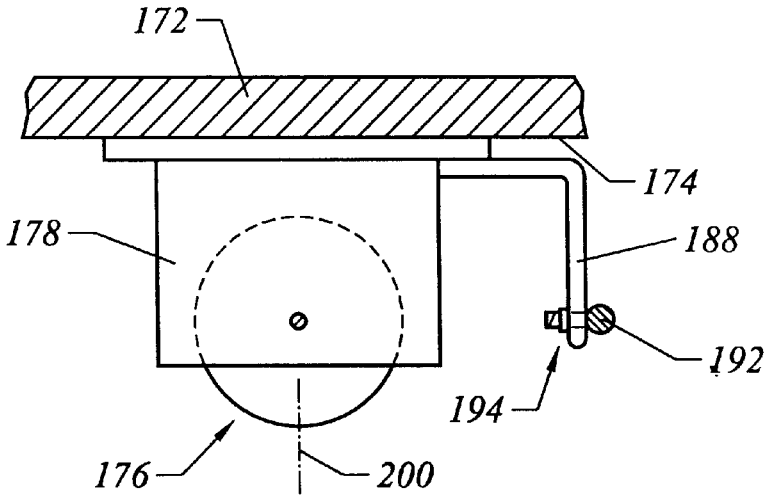
FIG. 18 is a sectional view taken along line 18—18 of FIG. 17.

With reference to FIGS. 17 and 18, an adjustable steering system 170 is depicted. Steering system 170 includes platform 172 having an undersurface 174 capable of supporting a multiplicity of wheels similar to that shown in FIG. 3. However, for the sake of illustrating steering system 170, only wheel 176 is depicted. Wheel 176 includes a swiveling hub 178 platform 180 is rotatable relative to platform 172 in the same manner as depicted with respect to the embodiments depicted hereinbefore and clearly shown in FIG. 4. Boss 182 connects to the underside 184 of platform 180 and extends through platform 172 at aperture 181. Boss 182 includes a slot 186. It should also be noted that a tab or boss 188 connects to hub 176 and includes a slot 190. A link 192 includes fastening means 194 and 196 which rotatably and adjustably connect boss 182 to tab 188. Directional arrow 198 indicates the directions of adjustment along slots 186 and 190 of boss 182 and tab 188, respectively. Thus, when wheel 176 is to be turned or steered, the degree of steering may be calibrated by moving link 192 upwardly or downwardly, as shown in FIG. 17 within slots 186 and 190. As illustrated in FIG. 17, link 192 provides maximum travel of wheel 176 about swivel axis 200.

Figure 19:
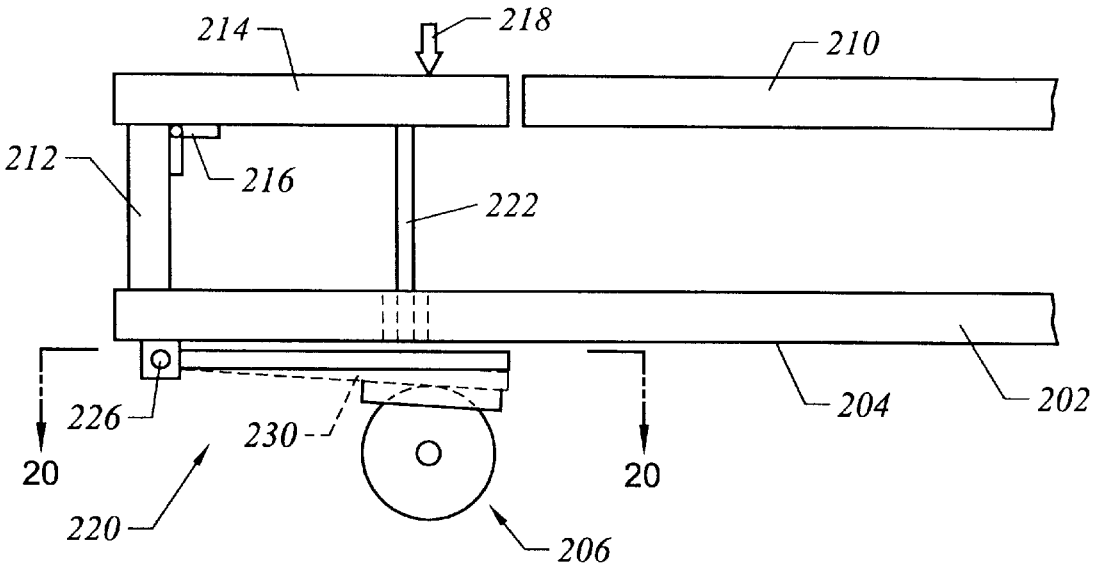
FIG. 19 is a broken side elevational view of a braking system of the present invention.
Figure 20:
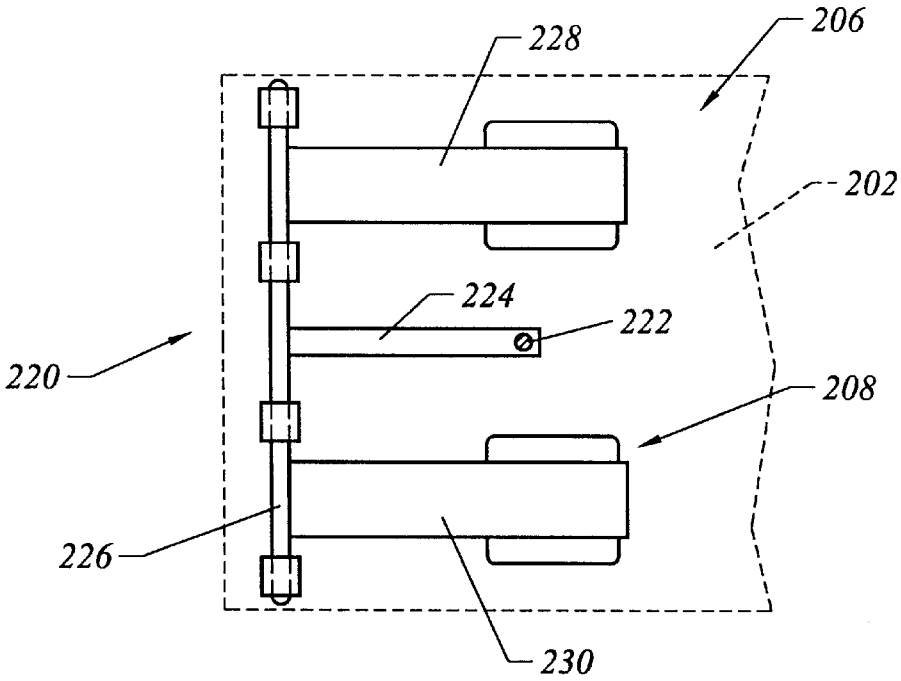
FIG. 20 is a sectional view taken along line 20—20 of FIG. 19, with the overlying platform shown in phantom.

Referring now to FIGS. 19 and 20, a braking system usable with the vehicles depicted in FIGS. 1–18 is shown. As depicted in the drawings, FIGS. 19 and 20, wheels 206 and 208 are shown. Platform 210 is supported relative to platform 202 as shown in FIG. 4, illustrated schematically in FIG. 19. Support 212 extending from platform 202 hingedly holds platform 214 as shown. Hinge 216 is spring loaded such that the downward force on platform 214, as shown by directional arrow 218, returns platform 214 to the position shown in FIG. 19. Braking system 220 includes a rod 222 which pushes on member 224 that is connected to a journaled shaft 226. Tongues 228 and 230 are connected to and extend from shaft 226. Thus, when platform 214 is pressed downwardly according to force arrow 218, rod 222 biases member 224 downwardly and causes tongues 228 and 230 to press against wheels 206 and 208. Thus, wheels 206 and 208 are impeded from turning causing braking.

In operation, the user mounts the upper surface 16 of second platform 14 of vehicle 10, FIGS. 1–5 and shifts his weight one way or another to tilt upper platform 16 relative to lower platform 12. Depending on the linkage chosen for wheels, 28, 30, 32, and 34, vehicle 12 will turn in a certain direction. It should be noted that damping or spring means may be used between platforms 12 and 14 to better control such tilting action. Moreover, springs or other shock absorbing structures may be employed with wheels 28, 30, 32 and 34, as is known in the art. With respect to embodiment 10A shown in FIGS. 6–9, a person may place one foot on first portion 78 of second platform 14 and another foot on second portion 80 of second platform 14. Tilting of these portions may take place independently and cause steering of vehicle 10A various ways depending on the linkage used with respect to wheels 28, 30, 32, and 34. In addition, either portion 78 or 80 of upper platform 14 may be rigged, as shown in FIG. 9, to effect braking of vehicle 10A. It should be noted that vehicles 10, 10A, and 10B may be operated in either direction. The vehicle 10B depicted in FIGS. 10 and 11 operates in a manner similar to the vehicle depicted in 10A, with the exception of the separation of the first and second portion 78 and 80 of second platform 14 and first and second portions 102 and 104 of first platform 12, to gain room between operators of vehicle 10B or to increase the wheel base of vehicle 10B.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A vehicle movable on at least first, second, and third swiveling wheels, comprising:

a. a first platform, said first, second, and third swiveling wheels rotatably attached to said first platform;

b. a second platform rotatably attached to said first platform;

c. a third platform rotatably attached to said first platform;

d. a fourth platform rotatably attached to said first platform, said second, third, and fourth platforms spaced further outwardly from the first, second, and third swiveling wheels than said first platform;

e. a first boss fixed to said second platform and extending to the vicinity of the first wheel;

f. a first link rotatably attached to said first boss and to the first swiveling wheel;

g. a second boss fixed to said third platform;

h. a second link, rotatably attached to said second boss and to the second swiveling wheel;

i. a third boss fixed to said fourth platform; and j. a third link rotatably attached to said third boss and to the third swiveling wheel.

2. The vehicle of claim 1 in which said second, third, and fourth platforms rotate independently of one another.

3. The vehicle of claim 2 in which said second, third, and fourth platforms are equidistantly spaced from said first platform.

4. The vehicle of claim 1 which additionally comprises a fourth swiveling wheel connected to said first platform adjacent the first swiveling wheel.

5. The vehicle of claim 4 in which said second, third, and fourth platforms rotate independently of one another.

6. The vehicle of claim 5 in which said second, third, and fourth platforms are equidistantly spaced from said first platform.

7. A steering system for a vehicle movable on at least first and second swiveling wheels, comprising:

a. a first platform, the first and second swiveling wheels being connected to said first platform for turning thereto;

b. a second platform rotatably attached to said first platform, said second platform spaced further outwardly from the first and second swiveling wheels than said first platform;

c. a boss fixed to said second platform and extending to the vicinity of the first swiveling wheel; and d. a link rotatably attached to said boss and rotatably attached to said first swiveling wheel, said boss further including a slot extending downwardly from said first platform, said link being locatable along said slot.

8. The steering system of claim 7 in which said first wheel includes a plate having a slot, said link being located on said slot of said plate.

* * * * *